US006967289B2

(12) United States Patent
Goto

(10) Patent No.: US 6,967,289 B2
(45) Date of Patent: Nov. 22, 2005

(54) ELECTRIC WIRE

(75) Inventor: Yoshihide Goto, Yamagata (JP)

(73) Assignee: Goto Electronic, Co., Yamagata (JP)

( * ) Notice: Subject to any disclaimer, the term of this patent is extended or adjusted under 35 U.S.C. 154(b) by 14 days.

(21) Appl. No.: 10/798,695

(22) Filed: Mar. 11, 2004

(65) Prior Publication Data

US 2004/0168822 A1 Sep. 2, 2004

Related U.S. Application Data

(62) Division of application No. 10/214,069, filed on Aug. 7, 2002, now abandoned.

(30) Foreign Application Priority Data

Mar. 19, 2002 (JP) ..... 2002-76473

(51) Int. Cl.[7] ..... H01R 13/33
(52) U.S. Cl. ..... 174/129 R
(58) Field of Search ..... 174/129 R, 133 R, 174/94 R

(56) References Cited

U.S. PATENT DOCUMENTS 290,769 A 12/1883 Gray
543,960 A 8/1895 Gray
796,100 A 8/1905 Wilson
2,149,772 A 3/1939 Hunter et al.
2,583,026 A * 1/1952 Swift ..... 174/117 R
4,458,106 A 7/1984 Ando et al.
5,696,352 A 12/1997 Kourimsky

FOREIGN PATENT DOCUMENTS

DE 195 19 582 A1 12/1996
DE 199 20 199 A1 6/2002

* cited by examiner

*Primary Examiner*—Chau N. Nguyen
(74) *Attorney, Agent, or Firm*—Reising, Ethington, Barnes, Kisselle, P.C.

(57) ABSTRACT

An electric wire having a conductive portion with grooves on the surface thereof to increase a surface area of the conductive portion for enlarging the skin effect in high frequency current and enhancing the transmissibility and the space factor in high frequency current is provided. The conductive portion 1*a* being made of an electric conductive material is formed on the surface 1*a* with a convexo-concave surface 3 to provide predetermined amount of grooves 2 or concave portions 20 having a predetermined section with a predetermined depth W extending in a direction of thickness or toward a center of the conductive portion on the surface of the conductive portion along lengthwise the conductive portion

8 Claims, 3 Drawing Sheets

ELECTRIC WIRE

RELATED APPLICATION

This application is a divisional of U.S. Ser. No. 10/214,069 filed on Aug. 7, 2002 now abandoned.

BACKGROUND OF THE INVENTION

1. Field of the Invention

This invention relates to an electric wire, which is enhanced on transmissibility of high-frequency current, especially to enlarge conductor skin effect in high-frequency current flow.

2. Description of the Related Art

When an alternating current flows as current I in an electrical conductive portion A, such as a metal, having uniform electrical conductivity σ and a frequency of the current is increased, the current does not flow in the center zone O of the electrical conductive portion A and the current flows concentratively in a surface zone B. The phenomenon is know as the conductor skin effect or the skin effect.

This phenomenon is caused by that an eddy current Ie to restrain a time response of a magnetic flux change by a circular magnetic field being generated in the conductive portion A by the current I and the eddy current Ie counterbalances the current I in the center zone of the conductive portion A and raises the current I in the surface zone B.

The current value is attenuated to 1/e at the skin depth δ being defined as a following formula:

$$\delta=(2/\omega\Xi\sigma)^{1/2}\quad \omega=2\pi f$$

$\mu$: magnetic permeability

σ: electrical conductivity e: base of a natural logarithm, 2.71828.

Thus, the current is decreasing in proportion to aparting from a surface.

To increase a current value with the skin effect, a ratio of a surface area against a sectional area of the conductive portion A may be increased advantageously. A square electric wire having a conductive portion A' with a square section as shown in FIG. 14 or a flat electric wire having a conductive portion A" with a rectangular section as shown in FIG. 15 was proposed instead of a round electric wire having a conductive portion A with a round section as shown in FIG. 12.

Objects to be Solved

However, a square electric wire having a conductive portion A' with a square section as shown in FIG. 14 or a flat electric wire having a conductive portion with a rectangular section as shown in FIG. 15 does not have enough current flow in a surface zone B by the skin effect. Especially, the transmissibility of current is being decreased in proportion to higher frequency.

To overcome the above drawback of prior art, one object of this invention is to provide an electric wire which is enhanced on transmissibility of high-frequency current, especially to enlarge conductor skin effect in high-frequency current flow.

SUMMARY OF THE INVENTION

How to Attain the Object

In order to attain the objects, an electric wire according to this invention is formed, on a surface of a conductive portion being made of an electric conductive material, with a convexo-concave surface to provide predetermined amount of grooves or concave portions having a predetermined section with a predetermined depth extending in a direction of thickness or toward a center of the conductive portion, on the surface of the conductive portion, along lengthwise the conductive portion.

Therefore, a surface area of the conductive portion of the electric wire is increased and the skin effect being caused by high frequency current is increased and then the current transmissibility in high frequency is enhanced.

Another electric wire, according to this invention, is formed by combining wire elements integrally to engage the convexo-concave surfaces of wire elements mutually, providing a convexo-concave surface on a conductive portion being made of an electric conductive material to provide predetermined amount of grooves or concave portions having a predetermined section with a predetermined depth extending in a direction of thickness or toward a center of the conductive portion, on the surface of the conductive portion, along lengthwise the conductive portion.

Therefore, a surface area of the conductive portion of the electric wire is increased and the skin effect being caused by high frequency current is increased and then the current transmissibility in high frequency is enhanced. Furthermore, the electric wire is formed by combining wire elements integrally to engaged the convexo-concave surfaces of wire elements, providing a convexo-concave surface on a conductive portion to provide the predetermined amount of grooves or concave portions having predetermined section, extending in a direction of thickness or toward a center of the conductive portion, on the surface of the conductive portion, along lengthwise the conductive portion, so that current of the combined wire can flow not only in surface zone of the conductive portion but also in the center zone of the conductive portion and then the current transmissibility is enhanced.

Another electric wire, according to this invention, is provided in the vicinity of the surface of the conductive portion being made of an electric conductive material along lengthwise thereof with predetermined amount of voids.

Therefore, a surface area of the conductive portion of the electric wire is increased and the skin effect being caused by high frequency current is increased and then the current transmissibility in high frequency is enhanced.

The electric wire, as mentioned above, is provided with a conductive portion being made of any of a metal such as copper, aluminum, iron or an alloy of them, plastic with dispersed electric conductive particles such as metal fiber or carbon black, electric conductive plastic such as electric conductive polymeric organic substance, or non-metallic electric conductors.

Therefore, the electric wire of which skin effect being caused by high frequency current is increased and then the current transmissibility in high frequency is enhanced can be easily manufactured in volume and supplied in a market by a low price.

The electric wire, as mentioned above, is provided with a conductive portion which cross section is formed into any shape selected from a group of round, square, rectangular, trapezoid, pentagon, hexagon, octagon or the other polygon.

Therefore, the electric wire of which skin effect being caused by high frequency current is increased and then the current transmissibility in high frequency is enhanced can be easily manufactured in volume and supplied in a market by a low price.

The electric wire, as mentioned above, is provided with a conductive portion which groove has a cross section being formed into any of V-shape, U-shape or trapezoid.

Therefore, the electric wire of which skin effect being caused by high frequency current is increased and then the current transmissibility in high frequency is enhanced can be easily manufactured in volume and supplied in a market by a low price.

The electric wire, as mentioned above, is provided with a conductive portion which has a cross section being formed into rectangular having elongated vertical side.

Therefore, the electric wire of which skin effect being caused by high frequency current is increased and then the current transmissibility in high frequency is enhanced can be easily manufactured in volume and supplied in a market by a low price.

The electric wire, as mentioned above, is provided with one wire element, having concave or convex portions of an amount of N and convex or concave portions of an amount of N+1 on at least one of the surfaces of one conductive portion, and the other wire element, which engages with the one wire element, having convex or concave portions of an amount of N+1 engaging with the concave or convex portions of the one conductive portion and concave or convex portions of an amount of N engaging with the convex or concave portions of the one conductive portion on the surface of the other wire element which corresponds to the surface of the one wire element.

Therefore, a surface area of the conductive portion of the electric wire is increased so that the skin effect being caused by high frequency current is increased and then the current transmissibility in high frequency is enhanced. Furthermore, the electric wire is formed by combining wire elements integrally to engaged mutually the convexo-concave surfaces of wire elements, providing a convexo-concave surface on a surface of a conductive portion, to provide the predetermined amount of grooves or concave portions having predetermined section, extending in a direction of thickness or toward a center of the conductive portion, on the surface of the conductive portion along lengthwise the conductive portion so that current of the combined wire can flow not only in surface zone of the conductive portion but also in the center zone of the conductive portion and then the current transmissibility is enhanced.

The electric wire, as mentioned above, is provided with one wire element, having concave portions of an amount of N on at least one of the surfaces of one conductive portion, and the other wire element, which engages with the one wire element, having convex portions of an amount of N engaging with the concave portions of the one conductive portion on the surface of the other wire element which corresponds to the surface of the one wire element.

Therefore, a surface area of the conductive portion of the electric wire is increased so that the skin effect being caused by high frequency current is increased and then the current transmissibility in high frequency is enhanced. Furthermore, the electric wire is formed by combining wire elements integrally to engaged mutually the convexo-concave surfaces of wire elements, providing a convexo-concave surface on a surface of a conductive portion, to provide the predetermined amount of grooves or concave portions having predetermined section, extending in a direction of thickness or toward a center of the conductive portion, on the surface of the conductive portion along lengthwise the conductive portion so that current of the combined wire can flow not only in surface zone of the conductive portion but also in the center zone of the conductive portion and then the current transmissibility is enhanced.

The above and other objects and features of this invention will become more apparent from the following description taken in conjunction with the accompanying drawings.

DESCRIPTION OF THE PREFERRED EMBODIMENT

Figure 1:
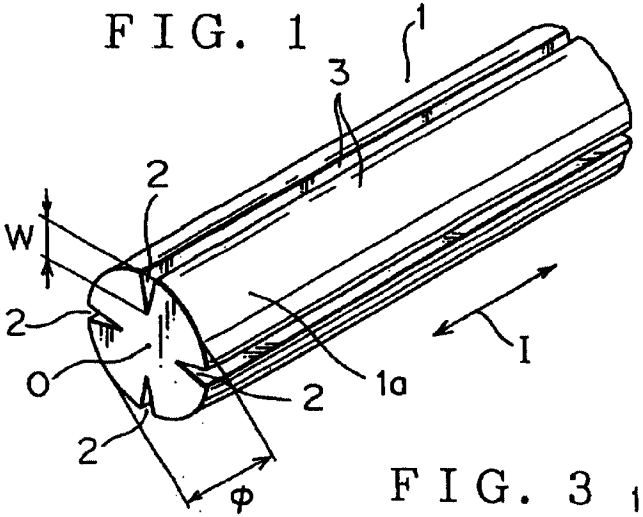
FIG. 1 is a perspective view of an electric wire of the first embodiment according to this invention.
Figure 2:
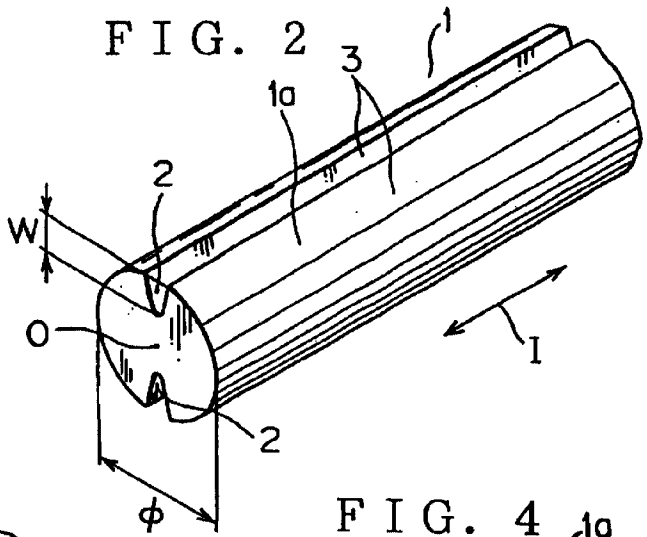
FIG. 2 is a perspective view of the other electric wire of the first embodiment according to this invention.

An embodiment according to this invention will now be described with reference to figures. FIG. 1 shows a perspective view of an electric wire according to a first embodiment of this invention. FIG. 2 shows a perspective view of the other electric wire according to a first embodiment of this invention.

In FIG. 1, the mark 1 is a conductive portion formed with an electric conductive material. The conductive portion 1 is formed on cross section thereof into round shape having a diameter of 0.1–1 mm, as shown in FIG. 1. The conductive portion 1 is provided with a convexo-concave surface 3 to provide the predetermined amount of grooves 2, four grooves 2 in FIG. 1, having predetermined section extending in a direction of thickness, i.e. toward a center O of the conductive portion 1 in FIG. 1, on a surface 1*a* of the conductive portion 1 along the longer direction I of the conductive portion 1.

The conductive portion 1 is made of any of a metal such as copper, aluminum, iron or alloy of them, plastic with dispersed electric conductive particles such as metal fiber or carbon black, electric conductive plastic such as electric conductive polymeric organic substance, or non-metallic electric conductors such as silicon, germanium or zirconium.

FIG. 1 shows the groove 2 to have a cross section formed into V-shape on the surface 1*a* of the conductive portion 1. Not limited to above, the groove 2 may be formed with a cross section of U-shape in the other electric wire according to a first embodiment of this invention shown in FIG. 2 or with a cross section of trapezoid shape, not shown.

When the conductive portion is made of metal such as copper, aluminum, iron or alloy of them, draw forming with a draw die or press forming with a press roller to form a required size of an electric wire is well known so that a groove 2 with a predetermined depth W on a surface 1*a* of a conductive portion 1 may be formed simultaneously. As the other forming method, a groove 2 can be formed by an electrical method with laser, maser, arc or plasma, or by grinding with a diamond fine tool and NC machine.

When the conductive portion 1 is formed with electrical conductive plastic or non-metal by injection molding or extrusion molding, a groove 2 may be formed simultaneously on the surface 1*a* of the conductive portion 1. As the other forming method, a groove 2 can be formed by an electrical method with laser, maser, arc or plasma, or by grinding with a diamond fine tool and NC machine.

Preferably, the groove 2 shown in FIG. 1 is formed toward the center O from the surface 1*a* of the conductive portion 1 to have depth W of approximately ⅓ of the diameter Ø.

The depth W of the groove 2 is determined to consider a diameter Ø or thickness of the conductive portion 1; current transmissibility in the skin depth of the conductive portion 1; electric conductivity; resistivity; required structural strength as an electric wire such as tensile strength, compressive strength or elastic modulus; weather resistance; toughness; temperature/humidity resistance; chemical resistance or manufacturability for forming.

According to the first embodiment of this invention as mentioned above, the conductive portion 1 is formed to have the round shape outline of cross section shown in FIG. 1 with any of metal such as copper, aluminum, iron or alloy of them, plastic with dispersed electric conductive particles such as metal fiber or carbon black, electric conductive plastic such as electric conductive polymeric organic substance, or non-metallic electric conductors. Preferably, the conductive portion 1 according to the embodiment has a diameter Ø of 0.1–1 mm, but the diameter is not limited.

Figure 12:
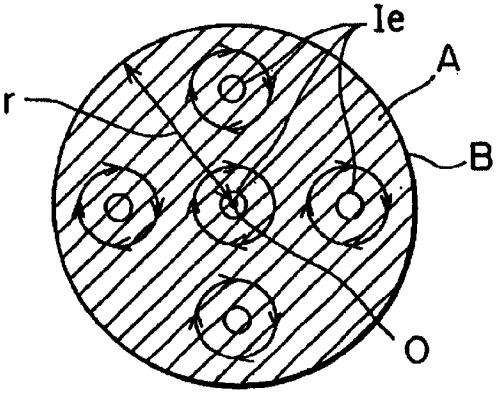
FIG. 12 PRIOR ART
FIG. 12 is a sectional view of a round electric wire by prior art, having a conductive portion with round section.
Figure 13:
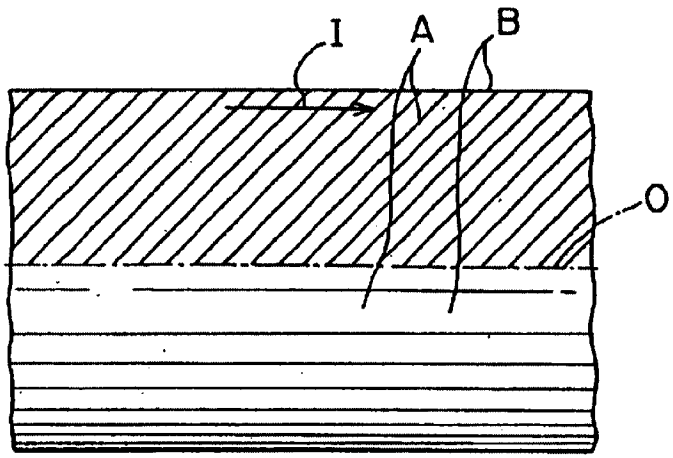
FIG. 13 PRIOR ART
FIG. 13 is a half-sectional view along lengthwise the electric wire shown in FIG. 12.
Figure 14:
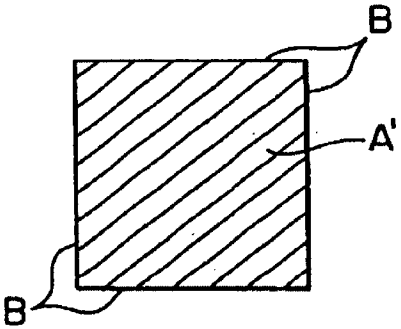
FIG. 14 PRIOR ART
FIG. 14 is a sectional view of a square electric wire by prior art, having a conductive portion with square section.
Figure 15:
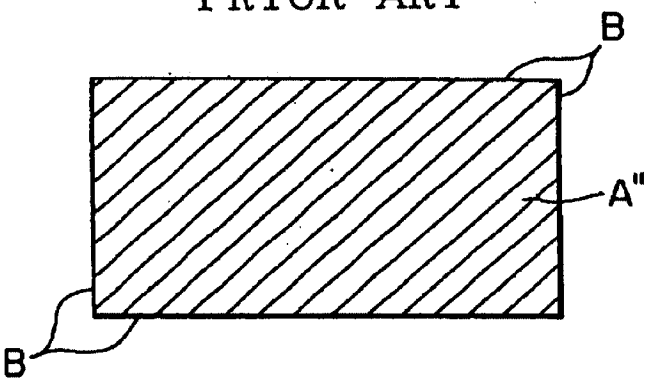
FIG. 15 PRIOR ART
FIG. 15 is a sectional view of a flat electric wire by prior art, having a conductive portion with rectangular section.

The conductive portion 1 is provided with a convexo-concave surface 3 to provide the predetermined amount of grooves 2, four grooves 2 in FIG. 1, having predetermined section extending in a direction of thickness, i.e. toward a center O of the conductive portion 1 in FIG. 1, on a surface 1*a* of the conductive portion 1 along the longer direction I of the conductive portion 1 so that a surface area of the conductive portion 1 is increased larger than a surface area of a round electric wire by prior art with round section shown in FIG. 12 and the space factor of the conductive portion 1 is increased. Therefore, current intensity flowing in the surface 1*a* of the conductive portion 1 is increased. Current can flow deeply at a bottom zone of the groove 2 extending in the direction of the thickness of the conductive portion 1 from the surface 1*a*. The current transmissibility of high frequency current is enhanced remarkably when the frequency of the current flowing in the conductive portion 1 may be increased, 1 kHz–100 kHz, 100 kHz–10 MHz, 10 MHz–1 GHz and more.

Not limited in figures, increasing the amount of the groove 2 formed in the conductive portion 1, the surface area of the conductive portion 1 can be increased larger than that in figure so that the current intensity can be increased by the skin effect.

Figure 3:
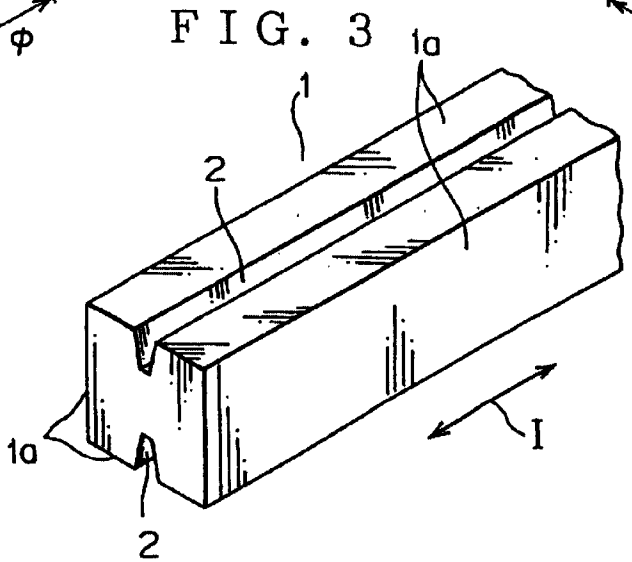
FIG. 3 is a perspective view of an electric wire of the second embodiment according to this invention.

FIG. 3 shows an electric wire according to a second embodiment of this invention.

According to the embodiment, instead of the first embodiment which conductive portion 1 has the round outline of the cross section shown in FIGS. 1 and 2, the conductive portion 1 has outline of a cross section being formed into square so that the space factor is improved and the resistance is reduced and then the current intensity flowing in the conductive portion 1 is increased by the skin effect. The structure and action of the second embodiment is similar as that of the first embodiment other than forming the cross section of the groove 2 with a predetermined depth W, extending in a direction of thickness from the surface 1*a* of the conductive portion 1, into trapezoid.

Figure 4:
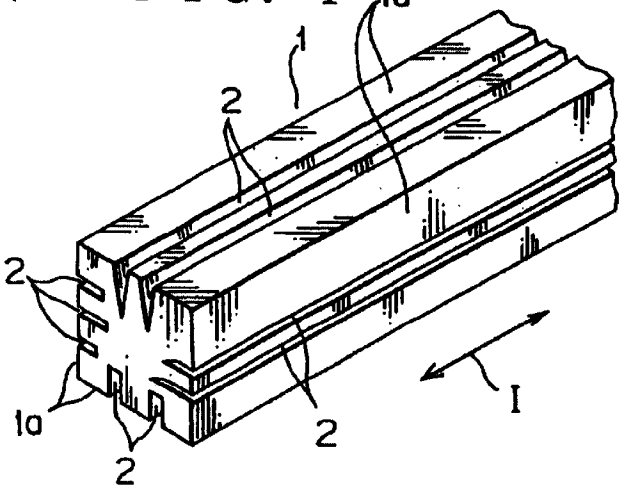
FIG. 4 is a perspective view of the other electric wire of the second embodiment according to this invention.

FIG. 4 shows the other electric wire according to the second embodiment of this invention. The conductive portion 1 is formed on cross section into square similarly as the electric wire shown in FIG. 3.

In the other electric wire, providing grooves 2 extending in the direction of thickness from four surfaces 1*a* of the conductive portion 1 to increase amount of mounting place for grooves 2 and amount of the grooves 2 more than those of the electric wire in FIG. 3, the surface area is increased more to enhance the current transmissibility. The structure and action of the other electric wire is similar as that of the electric wire shown in FIG. 3, other than forming the grooves 2 with not only V-shape cross section but also U-shape and trapezoid cross sections.

Figure 5:
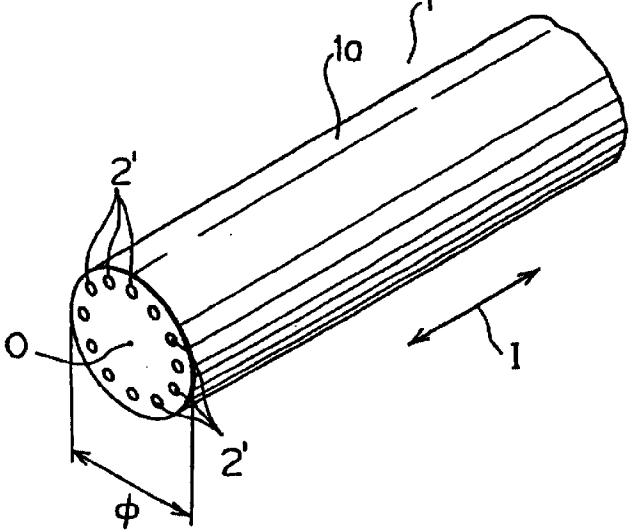
FIG. 5 is a perspective view of an electric wire of the third embodiment according to this invention.

FIG. 5 shows an electric wire according to the third embodiment of this invention.

Forming a conductive portion 1 with an electric conductive material and providing predetermined amount of voids 2' in vicinity of the surface 1*a* of the conductive portion 1 along the longer direction I thereof, the surface area of the conductive portion 1 is increased larger than a surface area of a round electric wire by prior art with round section shown in FIG. 12 and the skin effect is increased and the space factor of the conductive portion 1 is increased. Therefore, current intensity flowing in the surface 1*a* of the conductive portion 1 is increased. The current transmissibility is enhanced remarkably when the frequency of the current flowing in the conductive portion 1 is increased.

Figure 6:
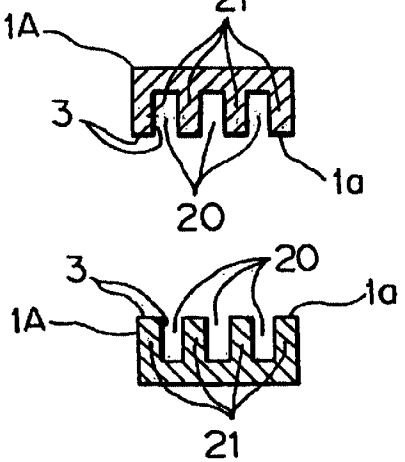
FIG. 6 is a sectional view of an electric wire of the fourth embodiment according to this invention.
Figure 7:
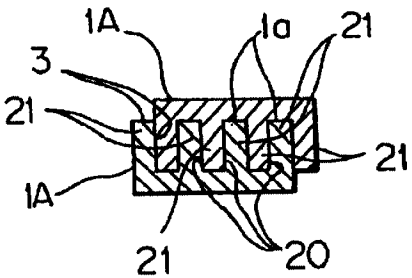
FIG. 7 is a sectional view of combined wire elements shown in FIG. 6.

FIGS. 6 and 7 show an electric wire according to the fourth embodiment of this invention.

Engaging the convexo-concave surfaces 3, 3 of two wire elements 1A, 1A, providing the convexo-concave surface 3 on a surface of each conductive portion 1 being made of an electric conductive material, to provide the predetermined amount of grooves 2 or concave portions 20 having predetermined section extending in a direction of thickness of the conductive portion 1, on the surface 1*a* of the conductive portion 1 along the longer direction I of the conductive portion 1, the wire elements 1A, 1A are combined integrally as a multi-conductor wire.

Physically, one wire element 1A (placed below in FIG. 6) is provided, on at least one of surfaces 1*a* (top surface of the wire element in FIG. 6), with concave portions 20 of an amount of N, three concave portions 20 in FIG. 6, and convex portions 21 of an amount of N+1, four convex portions 21 in FIG. 6, and the other wire element 1A (placed above in FIG. 6), which engages with the one wire element 1A (placed below in FIG. 6), is provided, on the opposite surface, with convex portions 21 of an amount of N+1, four convex portions 21 in FIG. 6, and concave portions 20 of an amount of N, three concave portions 20 in FIG. 6. The number N is an integer and can be changed freely larger or smaller, not limited in the figure.

Inserting N of the convex portions 21 of an amount of N+1, three convex portions 21 of four convex portions 21 in FIG. 6, being provided on the opposite surface of the other wire element 1A (placed above in FIG. 6), into the concave portions 20 of an amount of N, three concave portions 20 in FIG. 6, being provided on at least one of surfaces 1*a* of the one wire element 1A (placed below in FIG. 6) and abutting remained one convex portion 21 onto the outside of the right end convex portion 21 of the lower wire element 1A, inserting N, from right end, of the convex portion 21 of an amount of N+1, three convex portions 21 from right end of four convex portions 21 in FIG. 6, being provided with one pitch left shifting adjacently to the concave portions 20 on the one wire element 1A (placed below in FIG. 6) into the three concave portions 20 being provided adjacently to the convex portions 21 on the opposite surface of the surface 1*a* of the other wire element 1A (placed above in FIG. 6) and abutting remained one convex portion 21 onto the outside of the left end convex portion 21 of the upper wire element 1A, the convexo-concave surfaces 3, 3 of the upper and lower wire elements 1A, 1A are engaged mutually to combine the wire elements 1A, 1A integrally. Thus, solid multi-conductor wire can be formed easily.

In the shown embodiment, sifting the lower wire element 1A left with one pitch against the upper wire element 1A, the upper and lower wire elements 1A are combined. Not limited in the embodiment, shifting oppositely the lower wire element 1A right with one pitch against the upper wire element 1A, the upper and lower wire elements 1A can also be combined.

Thus, in the multi-conductor wire being formed with two wire elements as mentioned above, one wire element 1A (placed below in FIG. 6) is provided, on at least one of surfaces 1*a* (top surface of the wire element in FIG. 6), with concave portions 20 of an amount of N, three concave portions 20 in FIG. 6, and convex portions 21 of an amount of N+1, four convex portions 21 in FIG. 6, and the other wire element 1A (placed above in FIG. 6), which engages with the one wire element 1A (placed below in FIG. 6), is provided, on the opposite surface, with convex portions 21 of an amount of N+1, four convex portions 21 in FIG. 6, and concave portions 20 of an amount of N, three concave portions 20 in FIG. 6 so that the total surface area of two wire elements 1A, 1A are increased remarkably more than the surface area of the round electric wire by prior art with round section shown in FIG. 12. Therefore, the skin effect is enhanced and the space factor is increased. Thus, the current intensity in the surface 1*a* of the two wire elements 1A, 1A is increased remarkably. The current flows in the surfaces 1*a* of the two wire elements 1A, 1A so that the current can flow in a bottom zone of the concave portion 20 in the center zone of the conductive portion 1. The current transmissibility is enhanced remarkably when the frequency of the current flowing in the conductive portion 1 is increased.

The two wire elements 1A, 1A according to the embodiment, as shown in FIGS. 6 and 7, are formed into the same shape and the same structure so that the same forming machine with the same draw die or forming roller can be used for manufacturing the wire element 1A with a metal. The same molding die can be used for manufacturing the wire element 1A with a plastic material. Therefore, the cost of equipment is reduced.

Figure 8:
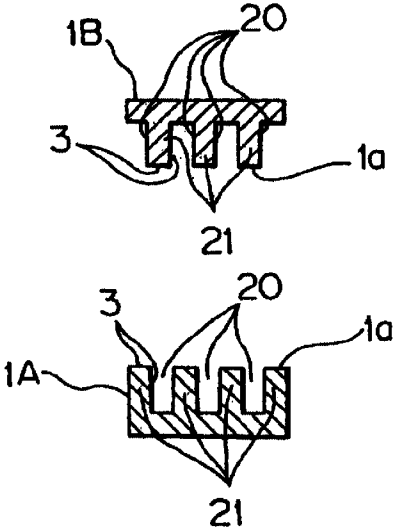
FIG. 8 is a sectional view of an electric wire of the fifth embodiment according to this invention.
Figure 9:
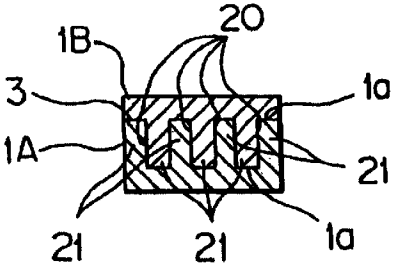
FIG. 9 is a sectional view of combined wire elements shown in FIG. 8.

FIGS. 8 and 9 show an electric wire according to the fifth embodiment of this invention.

Engaging the convexo-concave surfaces 3, 3 of wire elements 1A, 1B, providing the convexo-concave surface 3 on each surface of each conductive portion 1 being made of an electric conductive material, to provide the predetermined amount of grooves 2 or concave portions 20 having predetermined section extending in a direction of thickness of the conductive portion 1, on the surface 1*a* of the conductive portion 1 along the longer direction I of the conductive portion 1, the wire elements 1A, 1B are combined integrally as a multi-conductor wire. Similarly as the fourth embodiment, one wire element 1A, placed below in FIG. 8, is provided, on a surface 1*a* thereof, with convex portions 21 of an amount of N+1, four convex portions 21 in FIG. 8, and concave portions 20 of an amount of N, three concave portions 20 in FIG. 8.

However, in this embodiment, the other wire element 1B, placed above in FIG. 8, is provided, on at least one of surfaces 1*a* (bottom surface of the wire element in FIG. 8), with concave portions 20 of an amount of N+1, four concave portions 20 in FIG. 8, and convex portions 21 of an amount of N, three convex portions 21 in FIG. 8.

Inserting the convex portions 21 of an amount of N+1, four convex portions 21 in FIG. 8, being provided on the opposite surface 1*a* of the one wire element 1A (placed below in FIG. 8), into the concave portions 20 of an amount of N+1, four concave portions 20 in FIG. 8, being provided on at least one of surfaces 1*a* of the other wire element 1B (placed above in FIG. 8) and inserting the convex portion 21 of an amount of N, three convex portions 21 in FIG. 8, being provided adjacently to the concave portions 20 on the other wire element 1B (placed above in FIG. 8) into the three concave portions 20 being provided adjacently to the convex portions 21 on the opposite surface 1*a* of the one wire element 1A (placed below in FIG. 8), the convexo-concave surfaces 3, 3 of the wire elements 1A, 1B are engaged mutually to combine the wire elements 1A, 1B integrally. Thus, solid multi-conductor wire can be formed.

Thus, in the multi-conductor wire being formed with two wire elements 1A, 1B as mentioned above, one wire element 1A (placed below in FIG. 6) is provided, on at least one of surfaces 1*a* (top surface of the wire element in FIG. 8), with concave portions 20 of an amount of N, three concave portions 20 in FIG. 8, and convex portions 21 of an amount of N+1, four convex portions 21 in FIG. 8, and the other wire element 1B (placed above in FIG. 8), which engages with the one wire element 1A, is provided, on the opposite surface 1*a* thereof, with convex portions 21 of an amount of N, three convex portions 21 in FIG. 8, and concave portions 20 of an amount of N+1, four concave portions 20 in FIG. 8 so that the total surface area of two wire elements 1A, 1B are increased remarkably more than the surface area of the round electric wire by prior art with round section shown in FIG. 12. Therefore, the skin effect is enhanced and the space factor is increased. Thus, the current intensity in the surface 1*a* of the two wire elements 1A, 1B is increased remarkably. The current can flow in a bottom zone of the concave portion 20 being formed on the surfaces 1*a* of the wire elements 1A, 1B (i.e. in the center zone of the multi-conductor wire) so that the current transmissibility in high frequency is enhanced remarkably.

In the shown embodiment, combining the upper wire element 1B and lower wire elements 1A is explained. Not limited in the embodiment, turning upside-down the wire elements, the wire elements 1A, 1B may be combined.

Figure 10:
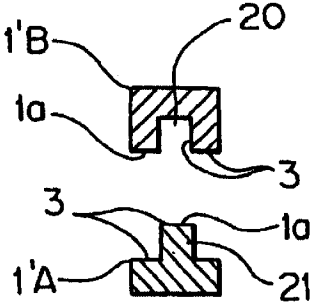
FIG. 10 is a sectional view of an electric wire of the sixth embodiment according to this invention.
Figure 11:
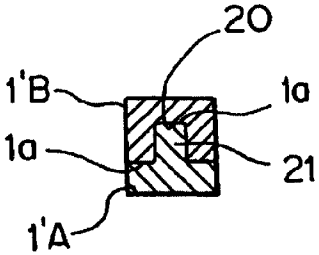
FIG. 11 is a sectional view of combined wire elements shown in FIG. 10.

FIGS. 10 and 11 show an electric wire according to the sixth embodiment of this invention.

In this embodiment, the other wire element 1'B (placed above in FIG. 10) is provided, on at least one of surfaces 1*a*, with concave portions 20 of an amount of N, one concave portion 20 in FIG. 10, and one wire element 1'A (placed below in FIG. 10), which engages with the other wire element 1'B, is provided, on the opposite surface 1*a* thereof, with convex portions 21 of an amount of N, one convex portion 21 in FIG. 10 to combine two wire elements 1'A, 1'B as a multi-conductor wire.

The total surface area of two wire elements 1A, 1B as a multi-conductor wire is increased more than the surface area of the round electric wire by prior art with round section shown in FIG. 12 so that the skin effects of the wire elements 1'A, 1'B are enhanced and the space factor is increased. Therefore, the current intensity in the surfaces 1*a* of the two wire elements 1'A, 1'B is increased and the current can flow in a bottom zone of the concave portion 20 being formed on the surfaces 1*a* of the wire elements 1'A, 1'B, i.e. in the center zone of the conductive portion 1. Thus, the current transmissibility is enhanced when the frequency of the current flowing in the conductive portion 1 is increased.

In the first embodiment shown in FIG. 1, 2 and the third embodiment shown in FIG. 5, the outline of the cross section of the conductive portion 1 is formed into round. In the second embodiment shown in FIG. 3, 4, the outline of the cross section of the conductive portion 1 is formed into square. In this invention, the cross section of the conductive portion 1 can be formed into any shape selected from a group of rectangular, trapezoid, pentagon, hexagon, octagon or other polygon, not shown in figure.

In the above embodiment, the place of the groove 2 or the concave portion 20 being provided on the surface 1*a* of the conductive portion 1 can be changed freely within the surface 1*a* and amount of the groove 2 or the concave portion 20 can be changed freely. The depth of the groove 2 or the concave portion 20 can be also changed freely.

In the fourth embodiment shown in FIGS. 6 and 7, locating one wire element 1A above and the other wire element 1A below, the one wire element 1A is combined with the other wire element 1A being shifted one pitch against the one wire element. In the fifth embodiment shown in FIGS. 8 and 9, locating a wire element 1B above and a wire element 1A below, the wire elements 1A and 1B are combined. In the sixth embodiment shown in FIGS. 10 and 11, locating a wire element 1'B above and a wire element 1'A below, the wire elements 1'A and 1' B are combined. All above is described as examples and locations of 1A, 1A; 1A, 1B; l'A, 1'B may be turned upside down or 90 degree to be right-left for combining as a multi-conductor wire.

While the forms of the invention herein disclosed constitute presently preferred embodiments, many others are possible. It is not intended herein to mention all the possible embodiments of the invention which will be apparent to those skilled in the art. It is understood that the term used herein are merely descriptive rather than limiting, in that various changes may be made without departing from the spirit or scope of this invention as defined by the following claims.

What is claimed is:

1. An electric wire comprising two wire elements, each said wire element including:

a conductive portion being made of an electric conductive material; and a convexo-concave surface being formed on the conductive portion to provide a predetermined amount of concave portions having a predetermined section with a predetermined depth extending in a direction of thickness of the conductive portion, on the surface of the conductive portion, along lengthwise of the conductive portion, so as to increase skin effect in a high frequency electric current, wherein the two wire elements are combined integrally to engage the convexo-concave surfaces of said two wire elements mutually, wherein the cross section of the conductive portion is formed into any shape selected from a group consisting of square, rectangular, trapezoid and any other polygon.

2. The electric wire according to claim 1, wherein the conductive portion is made of any one of a metal selected from a group consisting of copper, aluminum, iron and an alloy of them, plastic with dispersed electric conductive particles selected from a group consisting of metal fiber and carbon black, electric conductive plastic, electric conductive polymeric organic substance, and non-metallic electric conductors.

3. The electric wire according to claim 1, wherein the cross section of the concave portion is formed into any one of rectangular having an elongated vertical side, V-shape, U-shape and trapezoid.

4. The electric wire according to claim 1, wherein the conductive portion is made of any one of a metal selected from a group consisting of copper, aluminum, iron and an alloy of them, plastic with dispersed electric conductive particles selected from a group consisting of metal fiber and carbon black, electric conductive plastic, electric conductive polymeric organic substance, and non-metallic electric conductors, wherein the cross section of the concave portion is formed into any one of rectangular having an elongated vertical side, V-shape U-shape and trapezoid.

5. The electric wire according to claim 1, wherein one said wire element has concave or convex portions of an amount of N and convex or concave portions of an amount of N+1 on at least one of the surfaces of one conductive portion, and the other said wire element, which engages with the one wire element, has convex or concave portions of an amount of N+1 engaging with the concave or convex portions of the one conductive portion and concave or convex portions of an amount of N engaging with the convex or concave portions of the one conductive portion on the surface of the other wire element which corresponds to the surface of the one wire element.

6. The electric wire according to claim 1, 7 or 8, wherein one said wire element has concave portions of an amount of N on at least one of the surfaces of one conductive portion, and the other said wire element, which engages with the one wire element, has convex portions of an amount of N engaging with the concave portions of the one conductive portion on the surface of the other wire element which corresponds to the surface of the one wire element.

7. An electric wire comprising two wire elements, each said wire element including:

a conductive portion being made of an electric conductive material; and a convexo-concave surface being formed on the conductive portion to provide a predetermined amount of concave portions having a predetermined section with a predetermined depth extending in a direction of thickness of the conductive portion, on the surface of the conductive portion, along lengthwise of the conductive portion, so as to increase skin effect in a high frequency electric current, wherein the two wire elements are combined integrally to engage the convexo-concave surfaces of said two wire elements mutually, wherein the conductive portion is made of any one of a metal selected from a group consisting of copper, aluminum, iron and an alloy of them, plastic with dispersed electric conductive particles selected from a group consisting of metal fiber and carbon black, electric conductive plastic, electric conductive polymeric organic substance, and non-metallic electric conductors, wherein the cross section of the conductive portion is formed into any shape selected from a group consisting of square, rectangular, trapezoid and any other polygon.

8. An electric wire comprising two wire elements, each said wire element including:

a conductive portion being made of an electric conductive material; and a convexo-concave surface being formed on the conductive portion to provide a predetermined amount of concave portions having a predetermined section with a predetermined death extending in a direction of thickness of the conductive portion, on the surface of the conductive portion, along lengthwise of the conductive portion, so as to increase skin effect in a high frequency electric current, wherein the two wire elements are combined integrally to engage the convexo-concave surfaces of said two wire elements mutually, wherein the conductive portion is made of any one of a metal selected from a group consisting of copper, aluminum, iron and an alloy of them, plastic with dispersed electric conductive particles selected from a group consisting of metal fiber and carbon black, electric conductive plastic, electric conductive polymeric organic substance, and non-metallic electric conductors, wherein the cross section of the conductive portion is formed into any shape selected from a group consisting of square, rectangular, trapezoid and any other polygon, wherein the cross section of the concave portion is formed into any one of rectangular having an elongated vertical side, V-shape, U-shape and trapezoid.

* * * * *